US008425964B2

(12) United States Patent
Doglioni Majer

(10) Patent No.: US 8,425,964 B2
(45) Date of Patent: Apr. 23, 2013

(54) PROCESS AND CAPSULE FOR PREPARING BEVERAGES

(75) Inventor: Luca Doglioni Majer, Carate Urlo (IT)

(73) Assignee: Tuttoespresso S.p.A., Carono Pertusella (IT)

( * ) Notice: Subject to any disclaimer, the term of this patent is extended or adjusted under 35 U.S.C. 154(b) by 869 days.

(21) Appl. No.: 10/585,260

(22) PCT Filed: Jan. 24, 2005

(86) PCT No.: PCT/IB2005/000163
§ 371 (c)(1),
(2), (4) Date: Aug. 14, 2006

(87) PCT Pub. No.: WO2005/080223
PCT Pub. Date: Sep. 1, 2005

(65) Prior Publication Data

US 2009/0175986 A1 Jul. 9, 2009

(30) Foreign Application Priority Data

Jan. 26, 2004 (EP) ..... 04425042
Sep. 17, 2004 (WO) ..... PCT/IT2004/000503

(51) Int. Cl.

| | |
|---|---|
| ***A23L 1/28*** | (2006.01) |
| ***B65B 29/02*** | (2006.01) |
| ***A47J 31/06*** | (2006.01) |
| ***A47G 19/14*** | (2006.01) |

(52) U.S. Cl.
USPC ..... 426/433; 426/77; 426/431; 99/295; 99/323

(58) Field of Classification Search ..... 426/112, 426/115, 77, 84, 432, 433, 431; 99/295, 99/323
See application file for complete search history.

(56) References Cited

U.S. PATENT DOCUMENTS

| | | | | |
|---|---|---|---|---|
| 5,242,702 | A * | 9/1993 | Fond | 426/433 |
| 6,810,788 | B2 * | 11/2004 | Hale | 99/295 |
| 2006/0130664 | A1 * | 6/2006 | Majer Doglioni | 99/275 |

FOREIGN PATENT DOCUMENTS

| | | |
|---|---|---|
| EP | 1 243 210 A | 9/2002 |
| WO | WO 02/076270 A | 10/2002 |

* cited by examiner

*Primary Examiner* — Rena Dye
*Assistant Examiner* — Lela S Williams
(74) *Attorney, Agent, or Firm* — Oblon, Spivak, McClelland, Maier & Neustadt, L.L.P.

(57) ABSTRACT

A single serve capsule (1) for the preparation of hot beverages such as coffee, cappuccino, tea or the like from soluble or ground preparations, having an outlet lid portion (1 *b*) located on a dispensing wall (F) in order to form a dispensing opening (11) after a liquid has been introduced into the capsule, as well as means for changing the area of said dispensing opening during the dispensing step of the beverage.

17 Claims, 5 Drawing Sheets

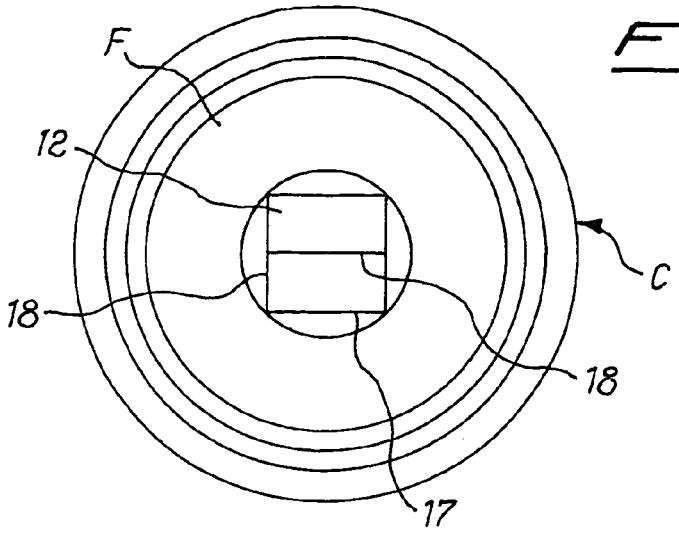
Fig.14
Fig.15
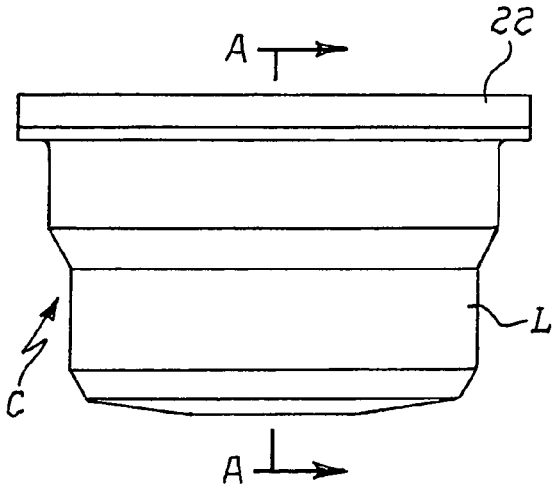
Fig.16
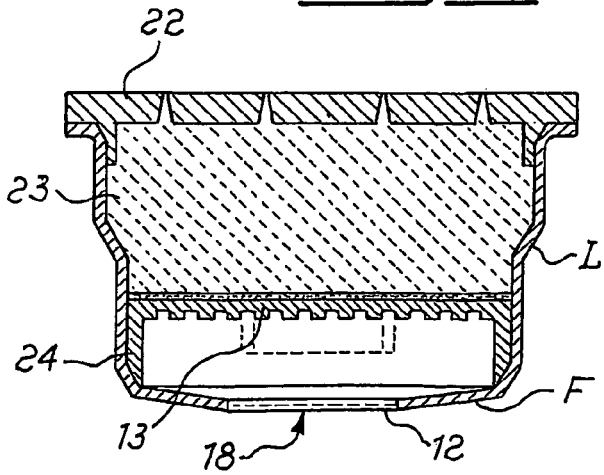

PROCESS AND CAPSULE FOR PREPARING BEVERAGES

FIELD OF THE INVENTION

The present invention relates to a process, a device and a single serve capsule for the preparation of beverages. More particularly, the invention relates to a method, a device and a single serve capsule for the preparation of beverages such as carried out in machines provided with a dispensing group intended for receiving a capsule of food preparation in order to obtain hot beverages such as coffee, cappuccino, tea or the like. The food preparation can be a soluble preparation or a product to be brewed such as ground coffee, tea and herbal remedies.

BACKGROUND OF THE INVENTION

Within the known types of machines, the assemblies intended for the preparation and the dispensing of beverages generally comprise a dispensing device having a seat receiving a single serve capsule.

Since the single serve capsules are originally sealed in order to prevent the soluble preparation from contacting the atmosphere and from leaking out during manipulation, the dispensing device is generally provided with a puncturing member or other means that opens one or more holes in at least one wall of the capsule, e.g. outlet holes on its bottom to provide an outlet for the beverage. In some cases an inlet hole for the liquid used to make the beverage (that is usually hot water) is also obtained at this step.

Once the capsule is positioned in the housing of the dispensing device and an exit for the beverage has been provided, hot pressurized water is fed to the capsule, through one or more inlet holes, to form a beverage, consisting of an infusion, dispersion or solution of the ground or soluble preparation in water. The beverage is then dispensed through the bottom outlet opening or hole. WO02/076270 discloses this type of embodiment.

Alternatively, as disclosed e.g. in EP 1243210, the capsule is located in its seat and pressurized hot water is fed inside the capsule to deform outwardly the bottom wall; a piston member pushes inwards a outlet lid provided on the bottom wall to form a permanent outlet for the beverage, the outlet lid being able to remain open also at the end of the dispensing step.

A good dispensing group must ensure complete and uniform solubilisation (or suspension/dispersion) of the whole product or of those parts of the product that upon brewing or infusion are solubilized into the hot water and a good final appearance of the beverage; for coffee and cappuccino, a good final appearance means having a "froth", i.e. a layer of foam made of small bubbles, which is lasting and in an appreciable amount. This result is difficult to obtain because the shape and size of the capsules are the same for all the dispensable products, whereas the amount of soluble product provided within a capsule changes according to its nature. For example, 1.5 grams of product are provided when the beverage to be dispensed is espresso coffee from a soluble espresso preparation, about 3.0 grams for tea leaves, about 6.5 grams when the product is ground coffee, and 15-16 grams, or more, of product are provided within the same capsule when the beverage is soluble hot-chocolate or cappuccino. This difference in quantities is reflected in the possible difficulty in consistently obtaining the required amount and quality of foam for each beverage.

Another problem with the known dispensing groups, particularly when milk-based soluble products are treated, is to ensure the hygiene of the group; this results into the requirement of avoiding the presence of small-sized cross-sectioned supply conduits and tubes (less than about 2 mm) because films and residues may be formed therein. Unfortunately, it appears that these small-sized conduits may be very useful to provide the required foam.

Previously mentioned patent application WO02/076270 in the name of the same applicant (incorporated herein by reference) describes a dispensing assembly wherein the puncturing member or piston acts as a means of opening a substantially circular portion on the capsule bottom. The diameter ratio of the piston and circular portion on the capsule bottom results in a throttling enabling to achieve good dispensing and production of foam or "froth".

It has however been observed that variations in the results are obtained depending on the products and the doses used and hence a need exists of having uniform results with the above described dispensing groups.

US Pat. Appl. 2003/00056661 to Hu et. al. and the corresponding application WO 02/080744 (corresponding to above mentioned EP 1243210) to Societé des Produits Nestlé describe a soluble product dispensing method wherein the outlet lid element open by the puncturing member is plastically deformed in such a position as to create a passage having reduced dimensions, i.e. a throttling, for the liquid outflow from the capsule. These dimensions remain constant over time while dispensing the beverage and at the end of the dispensing step the lid is open. In order to improve the formation of foam, the puncturing member is provided with channels having a cross section of less than 2 mm; alternatively, the channels are formed on the capsule, between two adjacent walls and in contact therewith.

This embodiment has drawbacks in that it does not operate in a reproducible and constant way and suffers from the above described problems regarding the blockage of the channels and their possible contamination with bacteria due to the formation of films and accumulations of residues within the channels. Furthermore, the capsule is complex and expensive to manufacture in view of the way the outlet lid is obtained within the bottom wall.

Therefore, a need exists for an improved beverage dispensing system, particularly for soluble beverages, which allows to obtain the required beverage and the required amount of foam, in a simple, hygienic and economical way.

SUMMARY OF THE INVENTION

The object of the present invention is to solve the aforementioned problems and to ensure constant and optimal results, from the point of view of the quality of the dispensed beverage.

Another object is to provide a capsule and a capsule-supporting assembly that have no hygiene problems.

This object is achieved by the present invention by means of a method for the preparation of a beverage from food preparations comprising the steps of:

- feeding an amount of liquid into a capsule (1) to dispense a beverage preparation contained within said capsule,
- forming a dispensing opening for said solubilised product, said opening having a dispensing area, through which a liquid can flow from inside said capsule to outside said capsule.
- dispensing the thus obtained beverage from said capsule through said dispensing opening, characterized in that said dispensing opening area changes at least twice during said step of dispensing the beverage from said capsule, i.e. before the all said beverage is dispensed. In practice, the area changes according to the value of the pressure within said capsule.

The opening area is corresponding to the flow section of the beverage.

Variation of the dispensing area occurs following the step of forming the dispensing opening, i.e. after an opening has been formed. In order to avoid the use of mechanical means to change the dispensing area, which would once again give rise to the aforementioned problems of blockage, fouling and "cross-contamination" by different products, the invention advantageously provides that said adjustment of the dispensing opening area is obtained by means of the pressure generated within said capsule by the liquid fed into the said capsule. The opening can be formed from outside towards inside or viceversa. In the first case a puncture member faces an outlet lid portion of the bottom of the capsule inside the capsule, in the second case the opening lid portion of the bottom is pushed outwards by the build-up of pressure within the capsule.

In both cases first a passage, i.e. an opening, is obtained in the bottom wall. This opening is then enlarged by the action of pressure exerted by the water pumped into the capsule. Because the opening area has been increased, a greater amount of liquid flows through the opening and the pressure within the capsule decreases. The consequence of the pressure decreasing is that because of the bottom wall material and/or design, the bottom wall moves back to an at least partially closed position, generally towards its initial position, i.e. the opening area becomes smaller (decreases).

This decrease of the opening area will result in a further increase of pressure and the cycle will be repeated until the water is no longer pumped into the capsule. In one preferred embodiment, decreasing and subsequently increasing of said dispensing area is provided.

A further object of the invention is a capsule for implementing the method according to the invention, comprising a capsule body, a dispensing wall and a wall outlet lid portion which is openable to form a dispensing opening for said beverage, characterised by comprising means for varying said dispensing opening area during the step of dispensing the beverage from said capsule.

In a preferred embodiment, the means for varying said dispensing opening comprise hinge means provided on the capsule wall where said opening is formed, and located between said dispensing opening and the capsule body in order to impart an oscillating movement to said wall during said dispensing step.

According to one aspect of the invention, such "hinge" is obtained by having different thicknesses of the dispensing wall: in particular, the thickness in the area surrounding and adjacent to the dispensing opening is greater than the thickness of the same wall adjacent to the side walls i.e. adjacent to the capsule body.

A further object of the invention is a capsule wherein at least part of the dispensing wall has a rigidity within the range of 5 to 60 N/mm measured by compression with a punch and the deflection set to 3 mm; with these values, a wall elasticity is obtained which enables the required movement.

According to another preferred aspect of the invention, in addition or alternatively to the above mentioned characteristics, the capsule of the invention provides that said hinge is located at the portion and that it is elastically deformable, i.e. that such outlet lid portion, is biased by the hinge to return to a substantially closed position as pressure within the capsule has decreased. The outlet lid may be open either inwardly or outwardly to the capsule. Thus, the hinge means acts elastically or visco-elastically to control the flow of the beverage as if a valve means is provided in the capsule: the area of the opening 11 increases and decreases with the increase or decrease of the pressure in the capsule, even if and when there is no direct or proportional correlation between pressure and opening area 11.

It is a further object of the invention a device for preparing beverages characterised according to claim 17.

According to a further aspect of the invention, the capsule is provided with filter means to retain the ground, spent, coffee, tea or other product, within the capsule upon brewing a beverage. In an embodiment of the invention the filter is spaced from the bottom wall by means of a spacer.

BRIEF DESCRIPTION OF THE FIGURES

Further characteristics and advantages of the present invention will be better understood from the following non-limiting description, with reference to the accompanying drawings, wherein:

FIG. 14 is a bottom view of the capsule of FIG. 12, with a top closure;

FIG. 15 is a lateral view of the capsule of FIG. 12 and

FIG. 16 is a sectional view along plane A-A of the capsule of FIG. 15, with a spaced filter element.

MODES OF CARRYING OUT THE INVENTION

Figure 1:
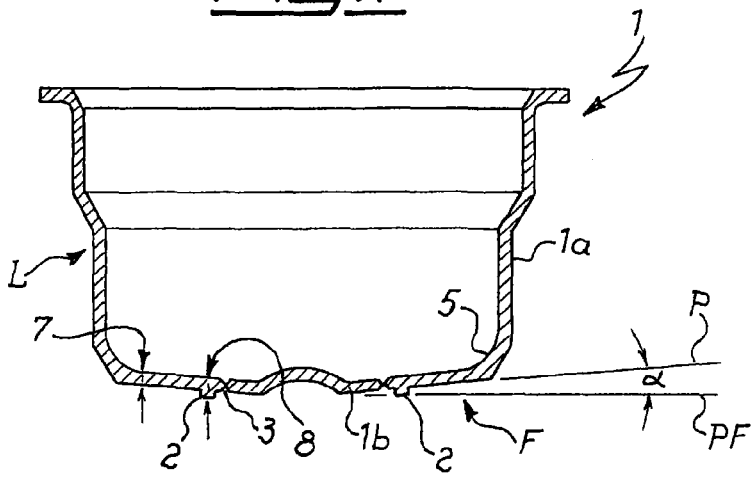
FIG. 1 is a sectional view of a capsule according to the present invention.
Figure 2:
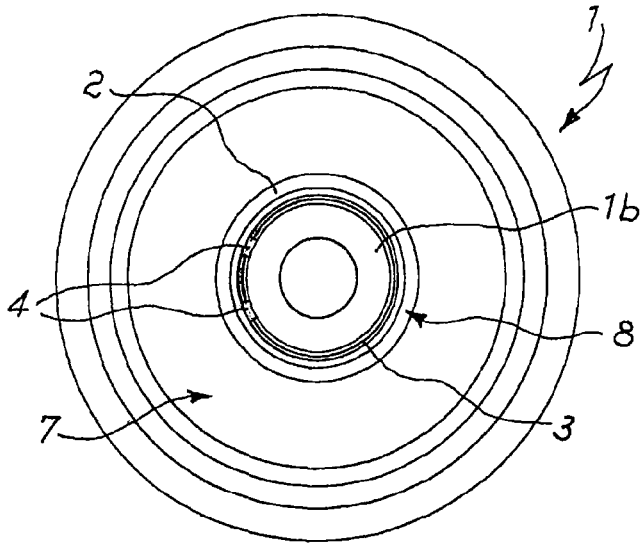
FIG. 2 is a bottom view of the capsule of FIG. 1.
Figure 5:
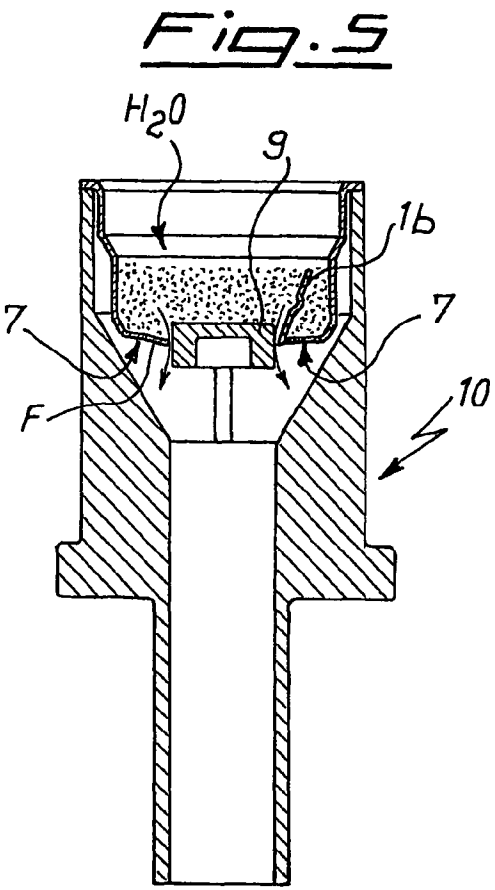
FIG. 5 is a sectional view of a capsule on a dispensing group.
Figure 3:
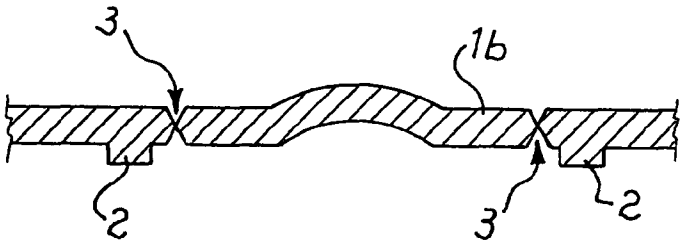
FIG. 3 is an enlarged, sectional view of a detail of the capsule bottom.

In the embodiment disclosed in enclosed FIGS. 1-3, the capsule 1, object of the invention, comprises of a portion 1*a* having a generally concave shape and comprising a capsule body having a generally cylindrical side wall L, and a dispensing wall F which, in the shown embodiment, is the capsule bottom wall. On the dispensing wall is formed a circular outlet lid portion 1*b* which can be open e.g. by a puncturing element, or piston 9, 9*a* of a dispensing group 10 or 10*a* (FIGS. 5 and 10) in order to form a dispensing opening.

The outlet lid portion 1*b* is obtained on capsule 1 by defining a fracture line 3 and a hinge 4 on the bottom of the capsule 1.

According to the invention, the capsule has means for varying the dispensing opening area, i.e. for increasing and decreasing the dispensing cross sectional area so as to vary the outflow of beverage from the capsule. Such adjustment is obtained by making use of the pressurising action exerted by the liquid on the capsule wall F after dispensing step is started and the water is pumped into the capsule. During the initial, "closed-capsule" step, for example when the capsule bottom wall is adhering to the piston or the outlet lid portion is still integral with the bottom wall F, the pressure within the capsule increases: once a sufficient pressure value is reached, a dispensing opening is formed through which the product is partially dispensed. The opening area increases to a maximum value. According to the invention, at this point the pressure within the capsule decreases, as well as the beverage dispensing area; this decrease leads to a new increase in pressure which in turn results in a new increase of the opening area.

In the disclosed embodiment both outlet lid part 1*b* of capsule 1, and fracture line 3 are circular; they may nevertheless have different shapes, for example ellipsoidal or with other kinds of fracture lines 3, depending on the type of piston used, the shape to be obtained for the opening in the bottom of capsule 1 and the type of dispensing opening to be obtained between the piston and the capsule wall F. In particular, according to an embodiment of the invention such opening is only present during dispensing: in this case reference is made to "zero or negative interference" between the piston and opening 1*b*, i.e. the piston portion which is engaged by the opening has a cross sectional area which is substantially equal to or greater than that of the opening. By "substantially equal cross section" is meant that at most the total air gap between the piston and the bottom of the capsule is about 1.0 mm and is preferably within the range of 0.01 to 0.5 mm.

FIGS. 5-8 show an embodiment of the invention wherein the capsule is engaged by a puncturing member 9 of a dispensing group 10.

Figure 6:
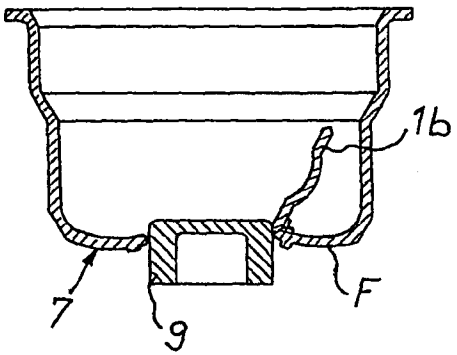
FIGS. 6, 7 and 8 are enlarged and views of the dispensing opening area variation movement in the embodiment of FIG. 5.

In accordance with this embodiment, the puncturing member 9 is slightly larger than opening 1*b*. In particular, with a cylindrical puncturing member and a circular opening 1*b* the ratio D1/D2, wherein D1 is the diameter of the cylindrical member where it engages the bottom wall F and D2 is the diameter of opening 1*b*, is within the range of 1.0 to 1.067, preferably within 1.01 to 1.03. In a preferred embodiment the difference between the puncturing member and the dispensing opening diameters is at most 2.0 mm, preferably 1.1 mm and more preferably between 0.05 and 0.8 mm. This means that soon after the puncturing member has been fitted into the dispensing opening there occurs what is shown in FIG. 6: the dispensing opening edges adhere to the puncturing member and are drawn towards the inside of the capsule.

When a liquid is fed into the capsule, generally with a substantially constant flow rate, by means of a dispensing apparatus pump, pressure inside the capsule increases because a dispensing opening is not provided; as the pressure value increases the dispensing wall F deforms outwardly to the capsule, eventually producing (FIG. 7) a dispensing opening 11 in the shape of a substantially circular crown around puncturing member 9. Upon formation of opening 11 an amount of beverage is dispensed from the capsule and the pressure drops: the bottom wall, no longer stressed by the same force, tends to return to the initial position in which it was adherent to the puncturing member and the opening area 11 is reduced in size in a greater or smaller rate in accordance with the nature of the wall F and the pressure still present within the capsule, possibly even reaching a very low value or substantially equal to zero. This condition is outlined in FIG. 8.

Figure 7:
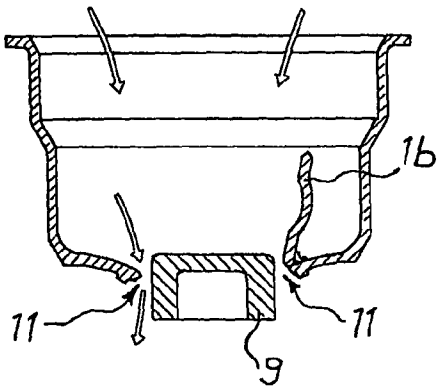

The additional liquid fed into the capsule causes the pressure therein to increase again until a wider opening area and increased beverage dispensing flow rate are obtained and the condition of the capsule is similar to the previous one, outlined in FIG. 7.

Figure 4:
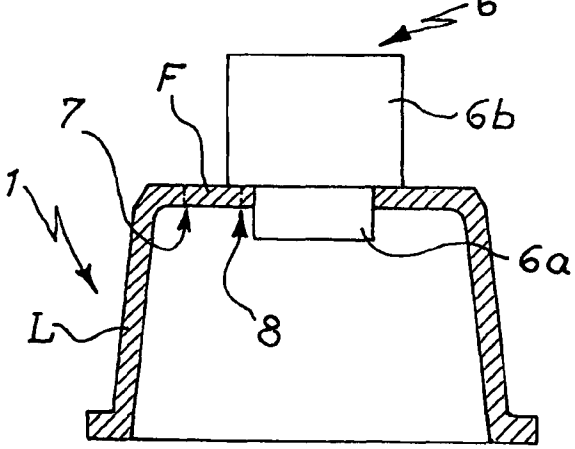
FIG. 4 is a view of the capsule during the compression test for the measurement of rigidity.

It has been found particularly advantageous that at least the dispensing wall of the capsule, i.e. the bottom wall F, has a rigidity within the range of 5 to 60 N/mm measured by compression with a punch and deflection set to 3 mm. Preferred rigidity ranges are 10 to 50 N/mm and 20 to 45 N/mm. The above mentioned rigidity is measured as shown in FIG. 4 and below described, and the values set out herein refer to this measurement method.

Capsule 1, without outlet lid portion 1*b*, is placed upside down on the rigid plane of a dynamometer; the bottom F is assimilated with a membrane with a central perforation. The measurement of rigidity is carried out by using a metallic punch 6 comprising a lower cylindrical portion 6*a* having a diameter corresponding to the nominal diameter of the opening obtained by removing the bottom piece 1*b*, and an upper cylindrical portion 6*b* with a diameter 2 mm greater than the diameter of portion 6*a*. Thus, punch 6 is centred on the opening in the capsule bottom wall F and engages this wall F by a circular crown of 1 mm. The measurement is performed on the dynamometer at a test velocity of 2 mm/min at a temperature of 23° C., with deflection set to 3 mm.

As mentioned, the claimed rigidity is within the range of 5 to 60 N/mm, preferably 10 to 50 N/mm and more preferably 20 to 45 N/mm.

Preferably, the dispensing wall F is provided with hinge means.

The hinge means can be implemented in several ways, according to the way the opening in bottom wall F is obtained. In the first embodiment previously disclosed, where a piston opens the outlet lid portion and engages the opening, hinge means are obtained in the bottom wall F.

References 7 and 8 in FIG. 4 indicate two points of bottom wall F where its thickness is measured. According to one aspect of the invention, capsule 1 has bottom wall where the thickness around, i.e. adjacent, the opening defined by portion 1*b*, for example in 8, is greater than the thickness, measured along the same cross section, adjacent side wall 1*a*, for example in 7, in order to obtain the required hinge.

This difference in thickness is preferably obtained by increasing or decreasing the thickness value from 7 to 8, but may also be obtained in a discontinuous manner, for example by means of a rib 2 (FIG. 1) located adjacent to portion 1*b*.

It is therefore an object of this invention a capsule as above described, wherein the thickness of said dispensing wall F around said openable outlet lid portion 1*b* is greater than the thickness of said bottom wall adjacent the capsule side walls.

As above mentioned, the distribution of the thickness values of the bottom is such as to allow, during the beverage dispensing step, an oscillating movement of the wall F without breaking or permanently deforming the bottom wall around opening 1*b*. Therefore, a further object of this invention is a capsule of the above described type characterised in that it has hinge means allowing alternate inward and outward motion of the dispensing wall, as a function of the pressure within said capsule during beverage dispensing from said capsule.

The position of the hinge substantially corresponds to the point of the bottom F where thickness is lowest, said point, as above specified, is preferably positioned adjacent the side wall L or between said wall and the midpoint between the wall L (FIG. 4), or portion 1*a* thereof (FIG. 1), and the edge 3 of the bottom, or dispensing, wall F.

In the embodiment shown, the side wall L of portion 1*a* connects with the bottom wall of capsule 1, where portion 1*b* is located, by means of an inner surface 5 shaped according to a curve and preferably, according to a circular arch. The radius of said arch preferably is within the range of 3 to 15 mm and more preferably of 5 to 12 mm.

As mentioned above, a rib 2 is provided outside and close to fracture line 3, with the purpose of having a thicker capsule bottom as described above, and of preventing the bottom of the capsule 1 from being excessively deformed within opening 1*b* during the opening step of the same by the perforating piston and particularly during the beverage dispensing step. Preferably the rib 2, as in the embodiment shown, completely surrounds fracture line 3; the rib may be more or less wide, but it starts from a position immediately adjacent the edge 3 of the opening 1*b* to avoid it breaking or deforming during the dispensing step.

In a preferred embodiment, the bottom wall F is entirely concave. Preferably, this concavity is obtained by suitably orienting the wall F to have it converging with side wall L towards the openable lid portion 1*b*, which is located centrally to the bottom wall. FIG. 1 illustrates the angle of inclination $\alpha$ of the plane of the bottom wall (P) with respect to the plane (PF) of the bottom wall if this is considered being perpendicular to side wall L.

Angle $\alpha$0 generally is within the range of 1 to 15 degrees and preferably of 3 to 10 degrees.

Therefore, a further object of this invention is the use of a capsule as above disclosed, with a dispensing group comprising a puncturing member, wherein the size of said puncturing member portion engaging said capsule bottom wall is greater than the size of said openable portion of said bottom wall.

Figure 9:
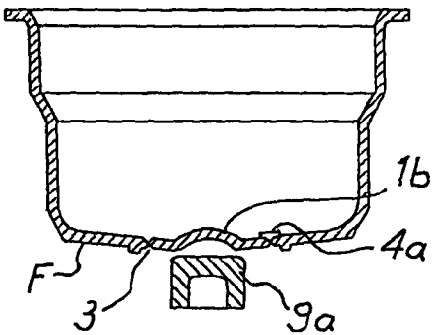
FIG. 9 is a view of a further embodiment of the invention.
Figure 10:
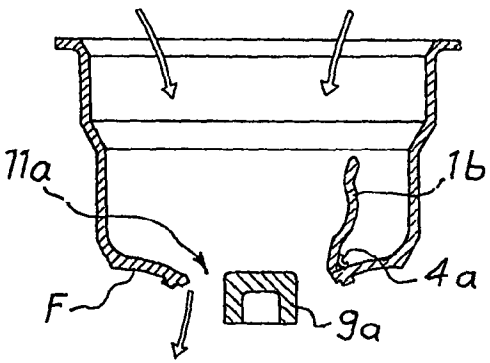
FIGS. 10 and 11 are enlarged views of the dispensing opening area variation movement in the embodiment of FIG. 9.
Figure 11:
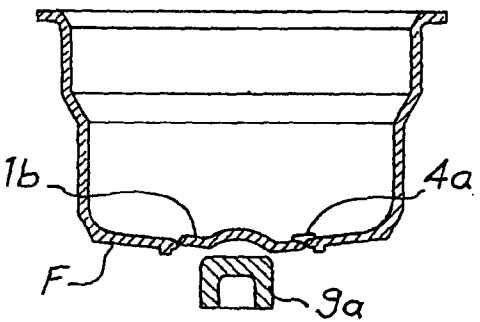

FIGS. 9-11 show the operation of another embodiment in accordance with the present invention.

In this embodiment, the dispensing opening is formed by the interaction of the openable outlet lid portion 1*b* with an opening member 9*a* located immediately below the capsule, as described in the above mentioned patent application in the name of Societé des Produits Nestlé. FIG. 9 shows this initial position wherein the opening member 9*a* is adjacent, in contact with or spaced a few millimetres away from outlet lid portion 1*b* of the capsule 1. The capsule is pressurized (FIG. 10) in a way such as described with reference to the previous figures: hot water fed into the capsule pressurises it and causes the dispensing wall F to bulge outwards and downwards so as to have outlet lid portion 1*b* to press against opening member 9*a*. Because of this interaction, lid portion 1*b* is opened along fracture line 3, thus forming an opening 11*a* through which the beverage flows out. As pressure decreases, the dispensing wall, i.e. the capsule bottom, returns towards the initial position, detaching from the opening element 9*a*; at this point the openable lid portion 1*b* moves once again towards the wall F, to a substantially closed opening position (FIG. 11) or to a decreased area opening position. The above considerations concerning the decreasing of the opening area from the condition of FIG. 10 to that of FIG. 11 also apply to this embodiment.

Figure 8:
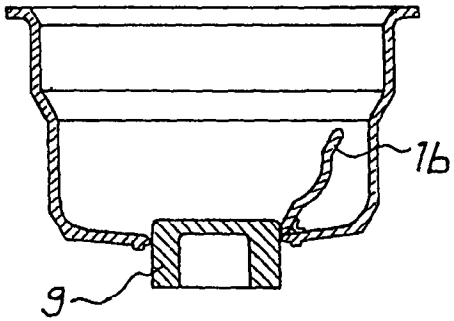

Similarly to the embodiment of FIGS. 6-8, once sufficient pressure is again built within the capsule, the latter will be once more deformed downwards and the opening area will increase again. The return of portion 1*b* to the closed position is made easier by the nature of the plastics material used and by providing a hinge 4*a* which is suitably sized to the purpose.

Thus, in this embodiment, the hinge means is the hinge connecting the outlet lid portion 1*b* to bottom wall F.

As previously mentioned, the capsule of the invention can be used for soluble products or for ground products, i.e. ground coffee, tea, herbal remedies, etc. In this case the capsule is provided with filter means and the openable lid portion can open by sheer pressure from inside to outside or, viceversa, by a puncturing element (piston) from outside to inside the capsule.

Figure 12:
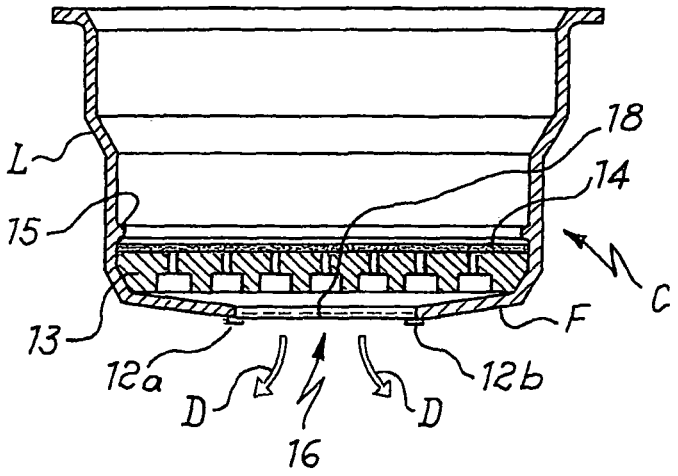
FIG. 12 is a sectional view of a capsule of the invention with a filter element.

FIG. 12 shows an embodiment of the invention wherein a filter unit consisting of a rigid support 13 and a filter paper 14, known per se in the art, are provided at the bottom of the capsule C. The lateral wall L of capsule C is preferably provided with a circumferential rib 15 protruding internally and spaced from the bottom so as to provide a means to block into position the filter unit.

Figure 13:
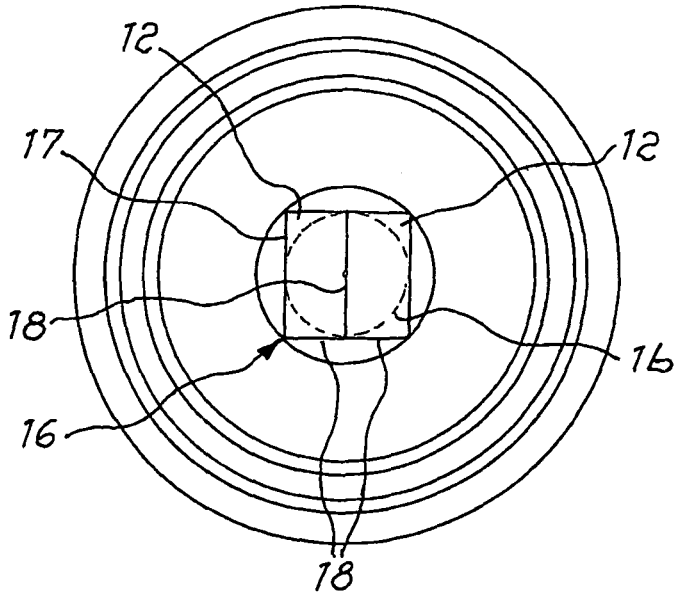
FIG. 13 is a top view of the capsule of FIG. 12.

The openable lid portion 16 of bottom wall F is defined by breaking lines 18 and hinges 17 that can give the outlet lid any suitable shape; e.g. besides the circular shape of outlet lid 1*b* above disclosed (shown in phantom lines in FIG. 13) a square shape (FIG. 13) or a cross shape (not shown) can be used.

The outlet lid 16 of FIGS. 12-16 has a square shape defined by the H-shaped breaking lines 18 and by hinges 17. In a corresponding cross shaped lid, the fracture lines are arranged in a cross.

This outlet lid (as well as all other outlet lids that are provided in a capsule having a filter unit at its bottom) opens towards the outside, as shown by arrows D in FIG. 23, once the pressure generated by the hot water pumped into the capsule is high enough to break the lid along breaking lines 18. The two halves of outlet lid 16 will then open in a "window" or "swing-door" way along hinges 17, and will then go back to a closed or almost closed position once the pressure has decreased, to subsequently open again upon a further increase of internal pressure.

The filter element is preferably at least slightly spaced from the bottom wall f of the capsule, to provide a volume where the beverage collects before leaving the capsule.

The FIGS. 14-16 show a capsule C provided with a filter element having the function of both filtering the ground coffee and of dividing, or partitioning, the internal volume of the capsule. The filter element 13 may have different shapes and dimensions depending on the specific uses which the capsule C is intended to.

The filtering/partition element 13 of FIG. 16 is formed by a spacer 24 having a predefined height extension, in such a way that once inserted in the capsule C, the internal volume of the container left available to the product 23 is reduced to the room between the upper surface of the spacer 24 and the top 22 of capsule C. A paper filter, or another approved material for food, is positioned between the top surface of filter 13 (above spacer 24) and the product 23. Another filter may be interposed between the product 3 and the upper wall of the capsule C.

With evident economic advantages, the spacer 24 allows the capsule C to be used both for the preparation of beverages from ground coffee and from soluble products. In the first case (coffee), the capsule C is coupled to the spacer 24 including filter 13, in the second case the capsule C does not comprise the spacer 24 and the internal volume of the capsule may be completely filled with the product 23.

Thus, the spacer 24 including filter 13 may be inserted in the capsule when the capsule C is filled with the product 23. If the amount of product 23 is for example not greater than 10 grams, the spacer 24 is inserted in the capsule and works as a double bottom and filter for the capsule C. If the product is soluble, the container 1 does not contain the spacer.

In this way it is possible to standardize the external dimensions of the capsule C, and vary the internal ones depending on the needs. It has to be noticed that the element for dividing the volume of the capsule may be provided also in the traditional capsules, i.e. independently by the means provided for the opening of the capsule.

Advantageously, spacer 24 allows to encapsulate product 23 according to the most opportune load and/or the compactness grade. In fact the reduction of the convenient volume of the capsule C may be designed to obtain the desired compactness grade for the product 23 in the capsule C.

The invention claimed is:

1. A capsule for the preparation of beverages from soluble preparations after a liquid has been fed to said capsule, said capsule comprising:

a dispensing wall and a dispensing wall lid portion that opens to form a dispensing opening for said beverage, said lid portion integrally connected to the dispensing wall at a fracture line, and a thickness of said dispensing wall in an area adjacently surrounding said lid portion is greater than a thickness of said dispensing wall adjacent side walls of the capsule, wherein said capsule includes means for repeatedly increasing and decreasing an area of said dispensing opening during dispensing the beverage from said capsule such that a cycle of increasing and decreasing the area of said opening repeats as long as the liquid is added to the capsule.

2. The capsule according to claim 1, wherein said means for repeatedly increasing and decreasing said area of said dispensing opening comprise hinge means.

3. The capsule of claim 2, wherein said hinge means are provided on the dispensing wall of the capsule in which said opening is formed, to impart an oscillating movement to said wall during said dispensing.

4. The capsule according to claim 2, wherein said hinge means are hinges that connect said dispensing wall lid portion to said dispensing wall, and said hinges bias said lid portion to return to an at least partially closed position after having been stressed into the open position before all the beverage has been dispensed.

5. The capsule according to claim 1, wherein at least part of said dispensing wall has a rigidity within a range of 10 to 55 N/mm measured by compression with a punch and deflection set to 3 mm.

6. The capsule according to claim 2, wherein said dispensing wall is inclined convergent towards said dispensing wall lid portion and wherein an angle of inclination of said wall towards said dispensing wall lid portion is within the range of 1 to 15 degrees.

7. The capsule according to claim 1 further comprising a filter element.

8. The capsule according to claim 7, wherein said filter element is spaced apart from a bottom wall of said capsule via a spacer.

9. The capsule according to claim 7, wherein said dispensing wall is configured to move outwardly relative to an interior of the capsule.

10. The capsule according to claim 3, wherein said hinge means are hinges connecting said dispensing wall lid portion to said dispensing wall, said hinges biasing said lid portion to return to an at least partially closed position after having been stressed into the open position before all the beverage has been dispensed.

11. The capsule according to claim 3 further comprising a filter element.

12. The capsule according to claim 2 further comprising a filter element.

13. A capsule for the preparation of beverages from soluble preparations after a liquid has been fed into said capsule, said capsule comprising:

a dispensing wall including an outlet lid portion to form a dispensing opening for said beverage, said lid portion integrally connected to the dispensing wall at a fracture line, and a thickness of said dispensing wall in an area adjacently surrounding said lid portion is greater than a thickness of said dispensing wall adjacent side walls of the capsule, and wherein at least part of said dispensing wall has a rigidity within the range of 10 to 55 N/mm measured by compression with a punch and deflection set to 3 mm such that an area of the dispensing opening repeatedly increases and decreases during dispensing of the beverage and a cycle of increasing and decreasing the area of said opening repeats as long as the liquid is added to the capsule.

14. The capsule according to claim 13 further comprising a filter element.

15. A capsule for the preparation of beverages from soluble preparations after a liquid has been fed to said capsule, said capsule comprising:

a dispensing wall and a dispensing wall lid portion which opens to form a dispensing opening for said beverage, said lid portion integrally connected to the dispensing wall at a fracture line, and a thickness of said dispensing wall in an area adjacently surrounding said lid portion is greater than a thickness of said dispensing wall adjacent side walls of the capsule, wherein said capsule repeatedly increases and decreases an area of said dispensing opening during dispensing the beverage from said capsule such that a cycle of increasing and decreasing the area of said opening repeats as long as the liquid is added to the capsule, and a hinge connects the dispensing wall lid portion to the dispensing wall and biases the dispensing wall lid portion toward a closed position.

16. A capsule for the preparation of beverages from soluble preparations after a liquid has been fed to said capsule, said capsule comprising:

a dispensing wall and a dispensing wall lid portion that opens to form a dispensing opening for said beverage, said lid portion integrally connected to the dispensing wall at a fracture line, a thickness of said dispensing wall in an area adjacently surrounding said lid portion is greater than a thickness of said dispensing wall adjacent side walls of the capsule, and said dispensing opening is formed when pressurized liquid inside said capsule pushes said lid portion outwardly of said capsule, wherein said capsule repeatedly increases and decreases an area of said dispensing opening during dispensing the beverage from said capsule such that a cycle of increasing and decreasing the area of said opening repeats as long as the liquid is added to the capsule.

17. The capsule according to claim 16 further comprising a filter element.

* * * * *